United States Patent [19]

Florian

[11] 4,096,986

[45] Jun. 27, 1978

[54] FOOD TRAY WITH INTEGRAL LOCK

[75] Inventor: John Florian, Bakersfield, Calif.

[73] Assignee: Mobil Oil Corporation, New York, N.Y.

[21] Appl. No.: 707,971

[22] Filed: Jul. 23, 1976

[51] Int. Cl.[2] ..... B65D 1/00; B65D 5/66; B65D 51/16

[52] U.S. Cl. ..... 229/44 R; 229/2.5 R; 150/0.5; 220/367

[58] Field of Search ..... 229/2.5 R, 2.5 EC, 44, 229/45; 150/0.5; 220/367, 358

[56] References Cited

U.S. PATENT DOCUMENTS

| | | | |
|---|---|---|---|
| 3,458,113 | 7/1969 | Swartzbaugh | 229/44 R |
| 3,471,078 | 10/1969 | Seest et al. | 229/2.5 EC |
| 3,511,433 | 5/1970 | Andrews et al. | 229/2.5 X |
| 3,876,130 | 4/1975 | Haase | 229/2.5 R |
| 3,902,540 | 9/1975 | Commisso | 150/0.5 |
| 3,938,726 | 2/1976 | Holden et al. | 229/2.5 R |
| 3,955,710 | 5/1976 | Commisso | 220/367 |

*Primary Examiner*—Davis T. Moorhead

*Attorney, Agent, or Firm*—Charles A. Huggett; James D. Tierney

[57] ABSTRACT

A foamed plastic food tray having a cover of the same material hinged to one side of the tray, is formed with a simple, secure latch constituted by a slotted portion of a strengthening rim on the periphery of the tray and an outwardly projecting flute with a flared out terminus on the front of the cover.

1 Claim, 7 Drawing Figures

Fig. 1
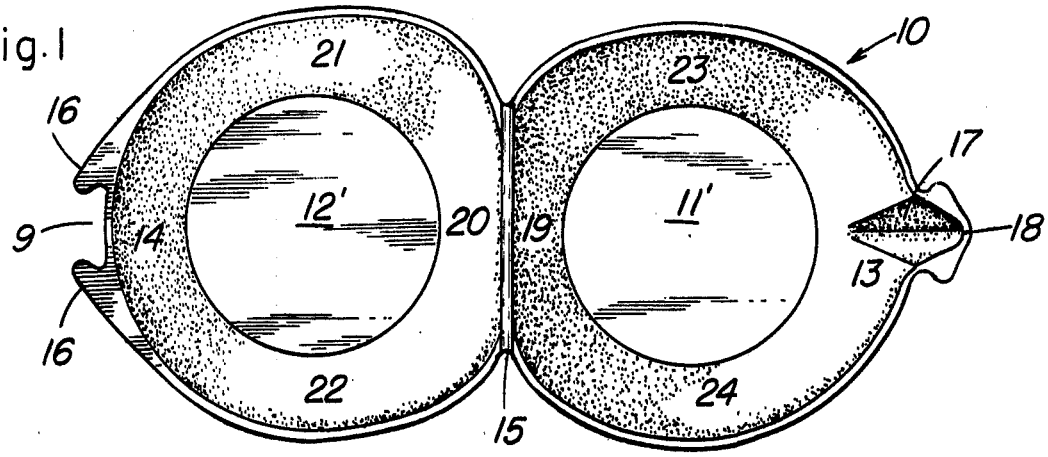
Fig. 2
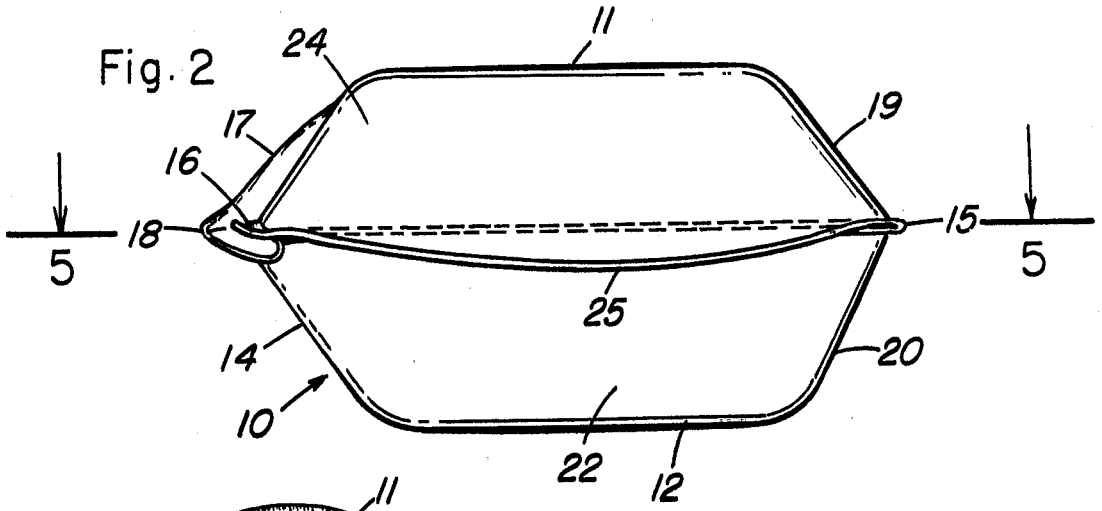
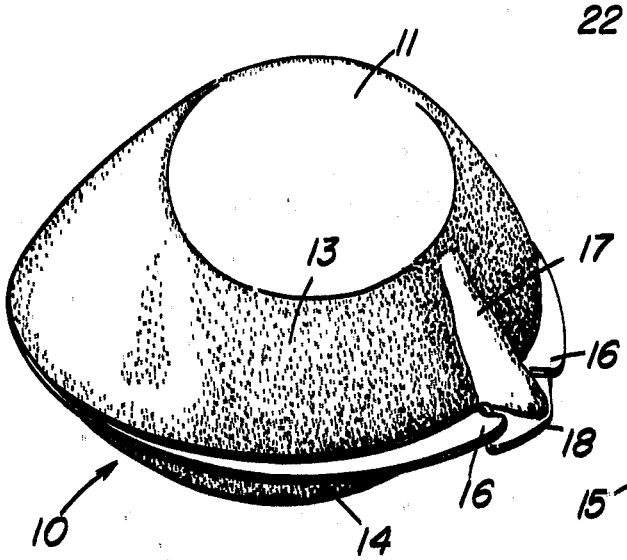
Fig. 3
Fig. 4
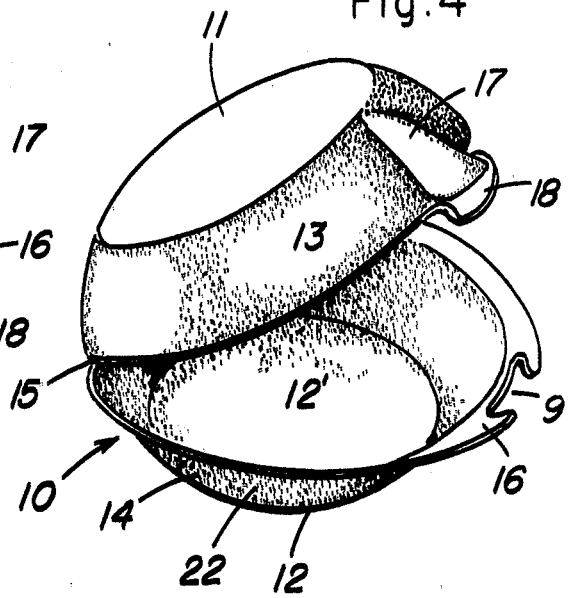

Fig. 5
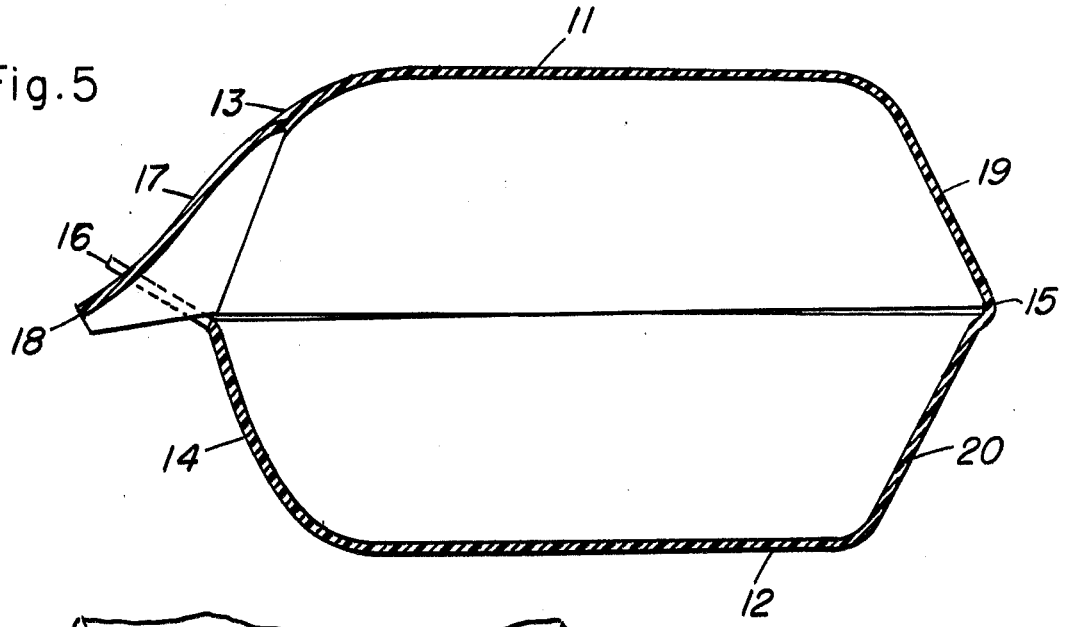
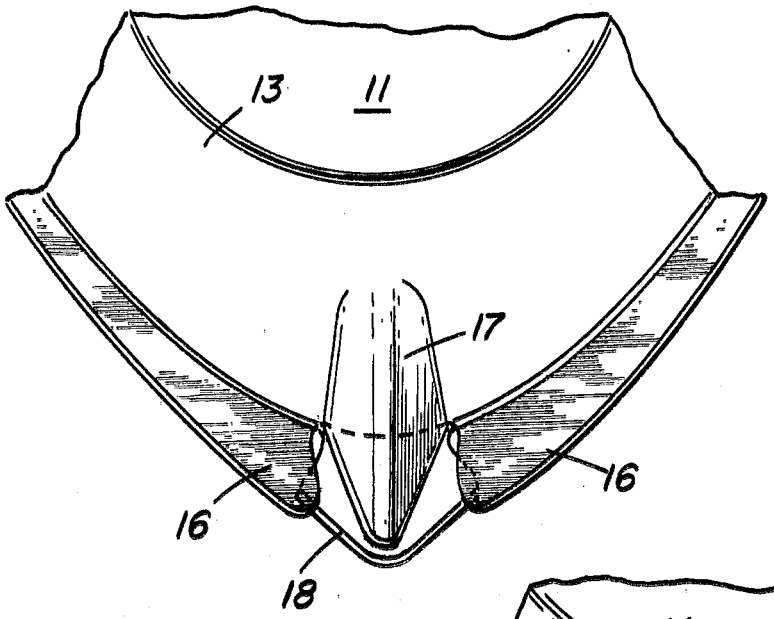
Fig. 6
Fig. 7
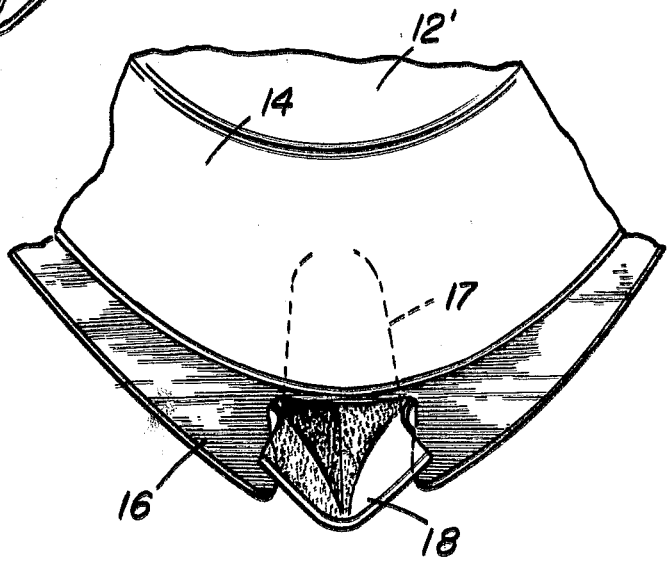

FOOD TRAY WITH INTEGRAL LOCK

FIELD OF THE INVENTION

The invention is concerned with a preformed package of general utility but particularly adapted to enclosure of prepared foods. Illustrative examples herein include packaging of complete meals and of hot sandwiches such as hamburgers or other fillings of sandwiches utilizing buns.

Prepackaged prepared foods are presently available in a great variety of contained food products and nature of packages. Frozen foods, either raw or prepared, must be enclosed by means which inhibit transfer of gasses and vapors, for example to prevent excessive loss of moisture resulting in "freezer burn". It will be recognized from the description hereinafter that the package of this invention is not inherently vapor-tight, in fact, for some purposes herein discussed, it is desirable to afford a substantial measure of ventilation. Such packages may be enclosed by bags, coated wrappers or the like known in the art, if freezing is desired.

The invention is, accordingly, more in the field of permeable or ventilated packaging which may be optionally wrapped for freezer storage. Such packages may contain sandwiches, such as those on a bun in which the filling is anyone of a variety of tasty meats and other foods, e.g., hamburgers, cheeseburgers, barbecued beef or pork, chicken, fish, sliced beef, etc. Depending on the election of the consumer, the so packaged food may be consumed immediately on the sales premises (where permitted); carried to automobile, home or picnic grounds for consumption after a relatively short inteval; stored under refrigeration for consumption within a few days; or frozen for storage over a longer period of time to be consumed at a time suiting the convenience or emergency of the consumer.

More or less complete meals are also prepared in package form, e.g. the widely sold frozen packages commonly referred to as "TV Dinners" which may be heated in the metal trays of the package when desired. More recently, institutional and industrial food suppliers have made use of disposable compartmented serving containers in which each of several foods intended for consumption at the same meal by one person is filled into a separate compartment of the tray or dish-like container. These are convenient for dispensing lunches and other meals at schools, industrial cafeterias, and other similar facilities. The technique is also applicable to use in galleys of planes, trains and watercraft, particularly sight-seeing boats.

Some of such packages use metal trays or dishes, generally aluminum, of light gauge and low cost, suitable for discard after consumption of the contained food. Such packages are heated, when desired, in radiant heat ovens over a period of time suitably long for raising the interior of the food to a desired elevated temperature without application of such intense heat radiation as to adversely affect the surface of the food. These metal packages are not suited to rapid heating in microwave ovens.

Other known food packages are bags of metal foil, paper, plastic film and the like. These are very effective for "carry-out" foods, such as hamburgers. They provide essentially no protection of physical integrity of the contained food and must be handled with care to avoid abrasion, crushing or other mechanical impairment of surface, form and arrangement of elements of the food, all of which are detrimental to the original appetizing appearance of the food, if not of its nutritive value.

Plates and other dishes of greater depth are often formed of pulp or plastic. A more recent development, described in U.S. Pat. No. 3,684,633, Haase, provides a variety of tableware which is thermoformed of foamed plastic having a layer of plastic film on at least one surface. The technology so described is applicable to formation of plates, bowls, cups, saucers, in fact of tableware generally. Covers suitable for such vessels are described in copending application of N.D. Commisso, Ser. No. 271,864, filed July 14, 1972.

The rigid dishes of plastic, like those of china, glass, etc., intended for repeated reuse may be covered by a sheet of protective material, such as foil, paper or plastic film to protect the contents from contamination. Such fragile elements leave the contents subject to physical damage or disarrangement, though to a lesser extent than the three-dimensional insecurity found with bags, as above described. Relatively rigid covers for permanent or disposable vessels are available in a variety of materials. These separate covers are inconvenient at best. A greater disadvantage is found when it is attempted to use separate vessels and covers in the preparation and dispensing of prepared foods on a large scale, as practiced by roadside "hamburger shops". In such environment, the use of separate vessels and covers is grossly wasteful of time in requiring that the packager draw from two separate sources of supply of packaging elements.

Food packages have been made by concurrent thermoforming of a lid and tray portion joined by an integral hinge and characterized by matching surfaces. These have been provided with such fasteners as a tongue projecting from one member engageable by an opening cut into the other whereby closure is effected.

SUMMARY OF THE INVENTION

The invention provides a packaging system uniquely suited to the needs of dispensers of food in large volume. This and other desirable objectives are achieved by an integral food-containing vessel and cover therefor joined by a linear hinge portion. Both vessel and cover may be of generally similar outline in cross-section, however dissimilar shapes may also be employed. The vessel and cover are each provided at their ends remote from the hinge area, with locking element means which cooperate to positively hold and lock the container in a closed, but reopenable, position. The front wall of the cover, i.e. the wall remote from the hinge, is provided with an outwardly projecting flute which diverges towards the bottom edge of the front wall of the cover and finally terminates in an outwardly-flaring, arrow-like head. The upper edge of the front wall of the container vessel portion is provided with a lip which extends outwardly and is inclined upwardly from the container vessel portion. The central portion of this lip is cut away to form a dove-tail like recess therein, which recess is adapted to receive, in locking engagement, the arrow-like head flaring, substantially in a horizontal direction, from the base or terminus of the flute member on the front wall of the container cover.

The security of closure in the package of this invention is provided by a positive mechanical latch as compared with the friction closure arrangement employed in other techniques for container closure. Once the container structure of the present invention has been closed by inserting the arrow-like terminus of the outwardly projecting flute on the covered front wall into the dove-tail slot formed by a cutaway portion of the upwardly inclined projecting lip on the front wall of the bottom section, the container may be easily reopened by merely applying slight digital pressure, or in effect pinching together the walls which constitute the outwardly directed flute, in an area just above the horizontally flared terminus of the flute. Thus, a positive latching means is provided for a container which guards against accidental opening of the container when extraneous forces are applied to the locking area whereby the container will only open with ease when the walls of the outwardly projecting flute are compressed.

These and other objects and advantages will be apparent from the annexed drawings, taken with the description below.

BRIEF DESCRIPTION OF THE DRAWINGS

FIG. 1 is a top plan view of a container according to the invention in open position.

FIG. 2 is a side elevation view of one form of the container in a closed position.

FIG. 3 is a fragmentary perspective view of the present container in closed and locked position.

FIG. 4 is a fragmentary perspective view of the present container in a partially opened condition.

FIG. 5 is a cross-sectional elevational view taken on line 5—5 of FIG. 2.

FIG. 6 is a fragmentary perspective top view of the container latching mechanism.

FIG. 7 is a fragmentary perspective bottom view of the container latching mechanism.

SPECIFIC EMBODIMENTS OF THE INVENTION

It is a principal object of the invention to provide a package, particularly for foods, which is readily fabricated on automatic, high-speed machinery of low cost materials having substantial heat insulating qualities. It is a further object that the open package, as supplied for filling and closing shall be nestable in the sense that a large number of empty packages can be stacked together, each within the cavities of an adjacent carton, such that the volume occupied is very little more than the sum of the thicknesses of walls of the packages. Such nesting results in major economies in shipping and storage. It is a further object that the empty packages be readily denested; that is, the empty packages in a stack should be capable of easy, rapid and uniformly smooth removal from the stack at either end for convenience and low cost of the filling and closing operation.

Further objects contemplate easy latching of the package and a secure mechanical detent when latched. It is further contemplated that the package shall be easily opened when desired and that it be capable of reclosing and reopening many times without substantially impairing security of closure.

The invention has, as additional objects, a rugged structure resistant to mechanical damage and capable of protecting the contents of the closed package against air-borne contamination without major inhibition of ventilation; it being understood that the package may be totally enclosed by films or like which are impervious to gases and vapors. A still further object is of particular importance when the package is so enclosed. That further object is provision of a package free of sharp corners and spurs on its exterior to avoid damage to the carton by "catching on" fabrics or projecting elements and to avoid danger of puncture to enclosing films.

The achievement of all these objectives simultaneously requires a particular combination of structural elements as provided by this invention. Constraints on available options are imposed by such features as the need for production on high speed molding machinery to provide for manufacture at an acceptable cost.

The container structure of the present invention offers a positive interlocking mechanism which overcomes many of the undesirable features of prior art container latches. For example, a common friction type lock wherein one container section is wedged into closing engagement with an adjacent section is undesirable since accidental opening of the container sections is practically unavoidable. Alternatively, the fragile tab type lock which comprises a tab which may be inserted into a slot is prone to accidental damage due to the fragile nature of the extending tab member. Locking arrangements which depend upon an undercut are extremely difficult to form and are usually characterized by being non-uniform. Containers which are provided with a punched hole on one container element adapted to receive a projecting member on the opposing element present manufacturing problems including secondary forming operations for in-line hole punching and its attendant registration problems. The present invention provides a positive locking mechanism whereby the lock is formed at the time the container is thermoformed and trimmed from the thermoplastic web. No secondary forming operations are required thereby eliminating complicated mechanical hardware and its maintenance requirements.

In the container structure of the present invention there is provided an outwardly-extending, projecting flute which is flexible, i.e. hinged along its apex. To effect disengagement of the sections it is merely necessary to manually flex the flute along its hinge line. Such an arrangement, as more completely hereinafter described, provides a lock which positively engages both container sections whereby the container is securely locked until it is desired to separate or open the sections.

Typical materials of construction which will provide the desired heat insulation and strength are foamed resins, such as foamed polystyrene, and pulp. The former is supplied as a web of foamed resin to a thermoformer in which the web is heated to a temperature high enough to permit reformation and drawing operations and is then pressed between cooling matching molds to the desired form. Pulp articles are formed from a suspension of paper fibers in water supplied to a screen conforming to the desired shape. A vacuum applied to the side of the screen opposite to the supply of water suspension causes the fibers to felt on the screen in the desired form. Upon drying, the finished product is removed from the screen.

Both forming operations here briefly described require that the form of the article be such that it is readily stripped at high speed from the forming element with a high degree of assurance. Faulty stripping of a single article, even to the extent of misalignment, results in jamming of the machine and costly shut-down to clear the jam. For that reason, surfaces of the formed article must be sloped such that stripping involves merely release from the surface of the forming element, as contrasted with sliding friction between surfaces parallel to the direction of withdrawal. There should be no undercuts, unless costly forming elements having retractable parts are provided.

These limitations on structure arising from the manner of manufacture are satisfied and the other objects are fulfilled by packages having features shown in the annexed drawings, wherein like parts are referred to by the same reference numerals.

A very useful form of the invention is embodied in the hamburger package shown in FIGS. 1, 2, 3, 4, 5, 6 and 7. It will be noted, however, that the locking mechanism of the present invention is clearly not limited to such structures but may be employed in another thermoformed container constructions including, for example, hinged lid multi-compartmented tray structures and other types of food or non-food container constructions. The structure illustrated, generally designated as 10, is adapted for dispensing of the well-known hamburger constituted by ground beef in a bun and is subject to wide variations by addition of cheese, vegetables, condiments and the like. The package comprises a vessel 12 and cover 11. These elements are formed simultaneously and integrally with each other as shown, for example, in FIG. 1. Along the line of division between the vessel 12 and cover 11 hinge means 15 is provided to assure that, on closing, the fold line will be in a predetermined hinge area 15 to assure registry of vessel and cover. In the embodiment shown, hinge line is defined by a compressed hinge line 15 in the foam, pulp or other material of construction.

The vessel 12 is of generally rectangular shape in horizontal cross-section with rounded corners and curved bulging sides formed by the side walls 21 and 22, and frong and rear walls 14 and 22 respectively, which slope outwardly in rising from the bottom 12' to a horizontal lip. The lip, formed integrally with the vessel 12 extends across the two sides and front 14 of the vessel 12 and is characterized by having an enlarged outwardly and upwardly extending portion 16 on wall 14 which is characterized by having a dove tail-like slot 9 cut therein. The cover 11 comprises a top wall 11' and side walls 23 and 24, front and rear walls 13 and 19 respectively, and is generally similar to the corresponding elements of the vessel 12 in size and configuration. Positioned centrally in the front wall 13 of cover 11 is an outwardly extending flute 17, the side walls of which converge outwardly as the flute descends from a point adjacent the top 11' to a point just below the horizontal lip which surrounds the lower edge of the bottom portion of the top member 11. As shown in the drawings, the outwardly projecting flute 17 terminates in an outwardly flared substantially horizontally extending arrow head-like projection 18.

When the package is closed by rotating the top section 11 about hinge line 15 and into engagement with the vessel section 12, the outwardly flared arrow head-like projection 18 engages the bottom surfaces, after passing through slot 9, of projecting lips 16 on the vessel section 12 whereby the two sections are positively locked in a closed position, as particularly shown in FIG. 3.

When it is desired to open the container, as shown in FIG. 4, it is only necessary to exert a slight digital pressure on opposite sides of projecting flute 17 whereby the arrow like projection 18 at the base of flute 17 is compressed thereby freeing it from engagement with slot 9 and projecting lips 16.

As shown in FIG. 2, the lower edge of side members 23 and 24 on cover section 11 may be provided with a downwardly depending skirt element 25. The skirt element 25, in addition to protecting the contents of container 10 from contamination, also ensures that pressure which may be manually exerted against side walls 23 and 24 of top section 11 will not result in inadvertent opening of the container as a result of unintentional compression of the outwardly extending side walls of flute 17. It will be obvious tht the pessure exerted on the side walls 23 and 24, by virtue of presence of skirt 25, will be resisted by side wall members 21 and 22 of vessel 12.

The package of this invention may be utilized in a variety of different ways. Having regard only to the hamburger package of FIGS. 1 through 7, it may be applied in dispensing products at roadside establishments by placing freshly cooked hamburgers in individual packages as cooking is completed and placing a supply at hand for prompt sale. The packaged food is adapted to be eaten at once or at a future time. Freshness will be retained in driving a short distance, as to a picnic ground. If longer delay is contemplated, the packaged product is easily reheated by a microwave oven without removal of the food from the package until heating is complete. Such microwave reconstitution of previously prepared (fully cooked) frozen food is a system in which the invention offers important advantages. This technique is not restricted to use by individual consumers. For example, hospitals find it efficient to freeze prepared foods and reconstitute the meals by microwave heating near the rooms of patients. In this manner, the food is served hot without being maintained in a heated cart for periods which result in loss of flavor. Many vessels available for the purpose have pronounced tendency to "pop" open in the microwave oven. The positive mechanism latch of the food container provided by this invention avoids that difficulty. Alternatively, sandwiches and other foods intended for consumption hot may be so packaged in the raw state (preserved in a freezer if desired) and cooked to taste when the occcasion arises.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A thermoplastic container comprising two dishlike sections which are hinged together along a common side by an integral flexible hingeline, cooperating locking means on each of said sections remove from said hingeline for releasably locking said sections together one of said locking means on one of said sections comprising an outwardly projecting flute which terminates in an outwardly flared arrow head shaped skirt, said second locking means on said other section comprising an upwardly inclined lip on a portion of the periphery of said other section, said lip having a central cut out slot adapted to receive, in locking engagement, said arrow head shaped skirt, said arrow head shaped skirt being compressed by finger action for insertion into said slot so that when said compression is released said arrow head shaped skirt expands in said slot to a locked position.

* * * * *